US005083736A

United States Patent [19]

McCoy

[11] Patent Number: 5,083,736

[45] Date of Patent: Jan. 28, 1992

[54] PENCIL HOLDER FOR GOLF CARTS

[75] Inventor: Paul A. McCoy, Augusta, Ga.

[73] Assignee: Club Car, Inc, Augusta, Ga.

[21] Appl. No.: 688,266

[22] Filed: Apr. 22, 1991

[51] Int. Cl.[5] ..... A47B 97/04

[52] U.S. Cl. ..... 248/452; 211/69.5; 224/274; 224/276; 248/309.1

[58] Field of Search ..... 248/452, 309.1, 314; 224/274, 277, 275, 278; 108/44, 45; 211/69.8, 60.1, 66, 69.5

[56] References Cited

U.S. PATENT DOCUMENTS

| | | | |
|---|---|---|---|
| 591,572 | 10/1897 | Rockwell | 211/66 X |
| 710,293 | 9/1902 | McClung | 211/69.8 X |
| 2,059,313 | 11/1936 | Carter | 248/635 X |
| 2,126,194 | 8/1938 | Kidrick | 211/69.8 |
| 2,650,836 | 9/1953 | Berman | 224/276 |
| 3,011,802 | 12/1961 | Ackerman | 224/276 X |
| 3,128,021 | 4/1964 | Habbena | 224/278 X |
| 3,847,275 | 11/1974 | Morrison | 220/8 X |
| 4,166,559 | 9/1979 | Richardson | 108/44 X |
| 4,974,805 | 12/1990 | Douglas | 108/44 X |

*Primary Examiner*—J. Franklin Foss
*Attorney, Agent, or Firm*—Laurence R. Brown

[57] ABSTRACT

A pencil holder and accompanying score card entry panel assembly is provided for mounting on the steering wheel of a golf cart. Pencils of various sizes and constructions are held by the pencil holder in a readily accessable position for manual retrieval and use by means of a resilient o-ring, which resiliently and frictionally grasps the pencil body. The pencil holder and an accompanying golf scorecard holder writing surface panel mate to form a clip-in assembly on a golf cart steering wheel assembly. The pencils are guided into the o-ring by means of grooves extending on either side to accomodate right or left handed users. A hooded cover extending over the grooves and the groove entry path protects the pencil point extending from the o-ring so that it does not get inadvertently damaged during storage, withdrawal or use of the cart and steering wheel.

13 Claims, 3 Drawing Sheets

PENCIL HOLDER FOR GOLF CARTS

TECHNICAL FIELD

This invention relates to pencil holders and clipboard assemblies and more particularly it relates to golf scorekeeping accessories including a pencil holder and accompanying writing panel assembly for mounting on a golf cart.

BACKGROUND ART

Pencil holders including those associated with clipboard assemblies are well known in the prior art. In particular such pencil holders and accompanying score card writing clipboards or equivalent writing panels have been well developed as golf scorekeeping accessories for use on golf bags or golf carts. Typical of such prior art are U.S. Pat. Nos. 4,449,310, May 22, 1984 to K.S. Kline for a golf bag accessory and 4,573,549, Mar. 4, 1986 to A.A. Pankow for a clipboard mount on the steering wheel of a golf cart.

Particularly when a golfer is out on the course and keeping score on a scorecard, the presence of a pencil is critical. Since a golf cart is usually used after each hole is finished it is convenient to fill out a scorecard to reflect the score for each hole at the golf cart site. Thus, a preferred place to keep a pencil and scorecard writing surface is at an easy to use place aboard the golf cart. The steering wheel site is ideally suited for this purpose since the driver may sit and have a scorecard and pencil available at a convenient writing height and position. However, if a pencil is not available, becomes lost or misplaced, or its point is broken, a golfer does not oridinarily think to carry a spare out on the course.

Thus preserving a pencil reliably in position on the steering wheel of a golf cart for use without a broken point to keep golf scores involves a critical set of conditions not fully satisfactory with any known prior art solutions. For example, the usual pencil holding spring metal clips may become sprung so that the pencil is loosely held and can be jarred out of the clip, particularly in the rather rough ride encountered in a golf cart over uneven terrain. This is a particularly difficult environment for any pencil holder clip that could ride in a position where gravity would tend to pull the pencil out of the clip. In the presence of vibration, for example, a metal frictional clip holding a pencil vertical to the ground could permit the pencil to slip downwardly and be lost.

Furthermore, the entry of the pencil into a clip or holder of conventional construction may be awkward or complicated so that misalignment of the pencil will affect the reliability of the grasp on the pencil body or cause breaking of the point.

Accordingly it is the object of this invention to provide an improved pencil holder that overcomes the prior art problems and unreliabilities, particularly in a golf scorekeeping accessory having particular advantage in a golf cart steering wheel mount.

DISCLOSURE OF THE INVENTION

Thus in accordance with this invention a pencil body is held by a resilient o-ring fitted into a housing structure compartment to receive a mating pencil body coaxially therein for storage and manual accessibility for ready use. The resiliency of the o-ring gives it a wide range of acceptable pencil shapes and sizes that can be reliably held. The housing structure forms guide grooves on either side of the o-ring for steering a pencil into place by either right or left handed users. To better protect the point from catastophic failure due to accidental intrusions of foreign objects, each groove is hooded near the intermediate o-ring position. This holding means is particularly reliable in the presence of vibration because of its holding of the pencil both resiliently and frictionally, even when pointed in any direction.

The pencil storage holder housing is preferably a separate unit which can be used independently or removably mounted on a golf score card retaining writing panel or equivalent clipboard array to provide an improved and reliable portable golf scoring accessory. A preferred configuration is adapted for snapping into the steering wheel of a golf cart.

Other objects, features and advantages of the invention will be found throughout the following description and claims, as will be more evident from the accompanying drawings.

BRIEF DESCRIPTION OF THE DRAWINGS

In the drawings, wherein like reference characters identify similar features in the several views to facilitate comparison.

THE PREFERRED EMBODIMENTS

Figure 1:
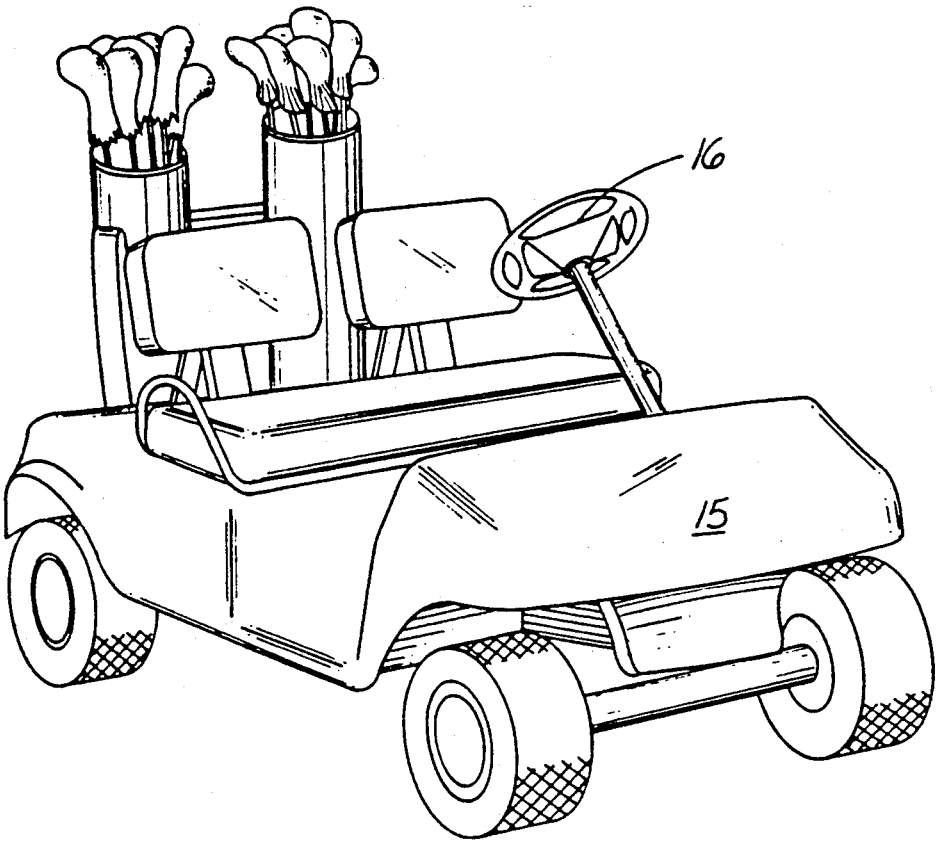
FIG. 1 is a perspective view of a golf cart with a pencil storage device and scorekeeping writing panel mounted on the steering wheel assembly in accordance with a preferred embodiment of this invention.

A golf cart 15 is shown in FIG. 1 having a steering wheel mounted golf scorekeeping accessory 16 for holding a golf scorecard on a writing surface panel and storing a pencil. This is a preferred location for score keeping since a golfer can comfortably sit down and reach the steering wheel mount as if writing at a desk after finishing each hole.

Figure 2:
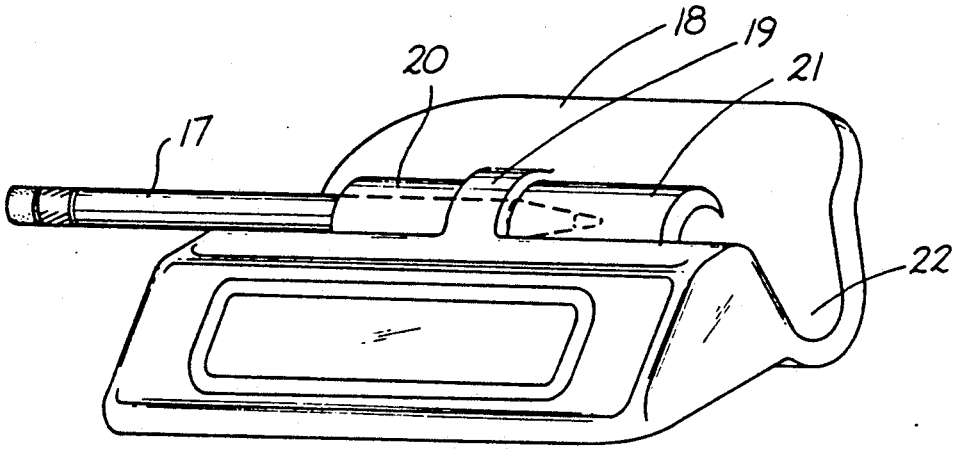
FIG. 2 is a perspective view of a pencil holder housing embodiment afforded by the invention.

The pencil storage holder 18 provided by this invention grasps a pencil 17 frictionally and resiliently by means of a resilient o-ring member, or the like, positioned in a suitable receptacle under the strap member 19 as shown in FIG. 2. The resiliency of the o-ring assures reliable grasping and holding of pencils of various diameters and body shapes. The pencil tip is protected under hoods 20, 21 from intrusion of foreign objects that would tend to break the point. Also to protect the point from accidental breakage while inserting into the holder, the grooves 22 on opposite sides of the o-ring to accomodate both right handed and left handed users guide the pencil and tip coaxially into the o-ring aperture, avoiding contact with any surface or force tending to break the pencil point. The o-ring aperture diameter is slightly less than the smallest diameter pencil body to be accomodated, and the groove dimensions are slightly wider than the largest diameter pencil body to be accomodated.

Figure 3:
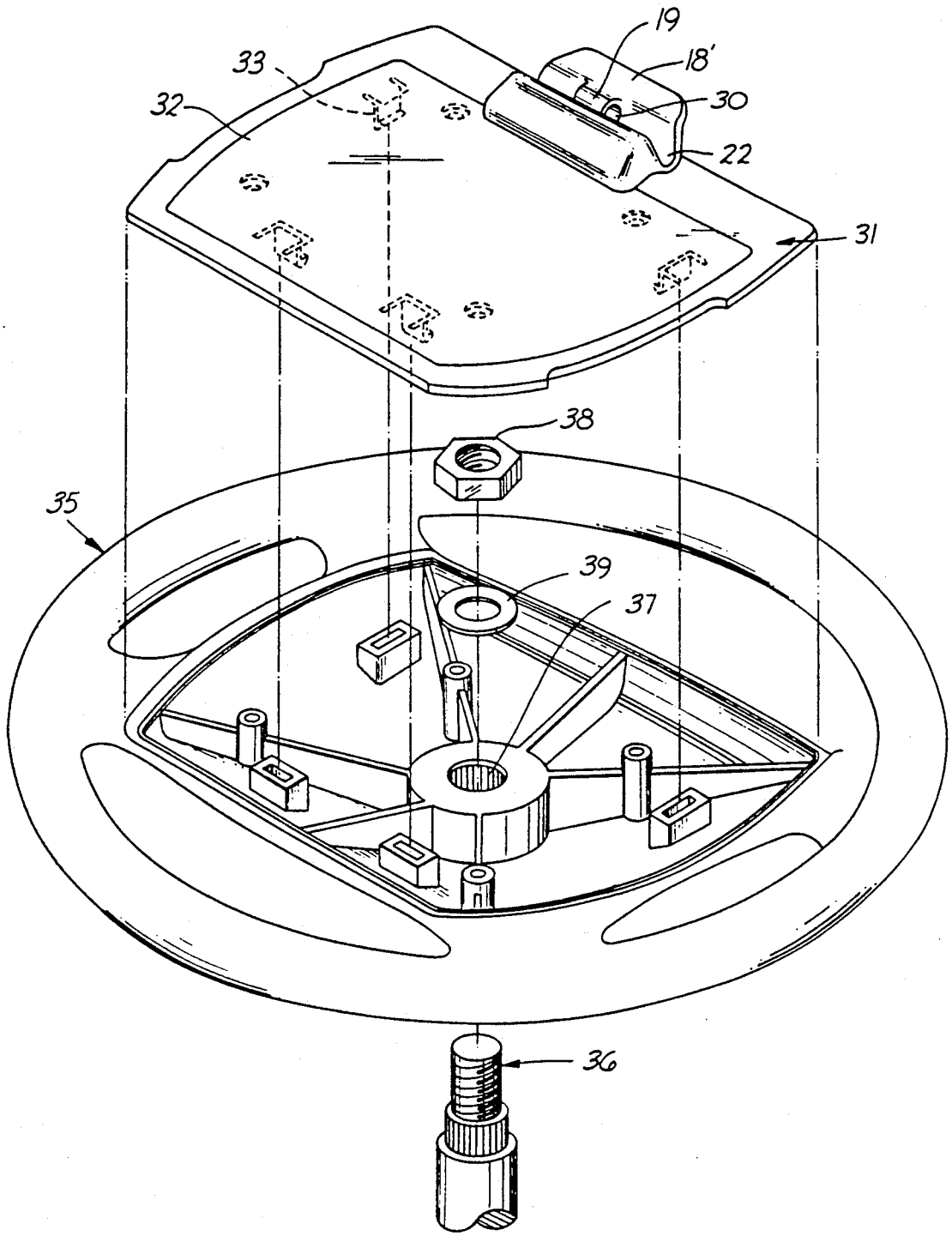
FIG. 3 is an exploded perspective view of a steering wheel mount of the pencil holder of this invention with accompanying golf score card writing panel.

In FIG. 3 the pencil storage holder 18', without the hoods over the pencil inserting grooves 22, is affixed to a score card receiving planar panel member 31 so that a user can remove a pencil from the housing structure aperture 30 aligned with an internally mounted o-ring and write on a scorecard placed on the attached writing panel 32. The scorecard can rest on the writing surface 32 for entries, and also it may be clipped in place for holding between holes in a manner not shown.

In this preferred embodiment, the accessory is structured to become affixed to the steering wheel assembly 35 of a golf cart by snap-in friction fit insertion of flexible clips 33 underneath the writing panel surface 32 into mating receptacles 34 of the steering wheel assembly 35 as shown by phantom lines. Thus, a special steering wheel assembly 35 adapted for the scorekeeping accessory mount may be mounted to the steering column 36 by means of bushing 37, washer 39 and nut 38.

Figure 4:
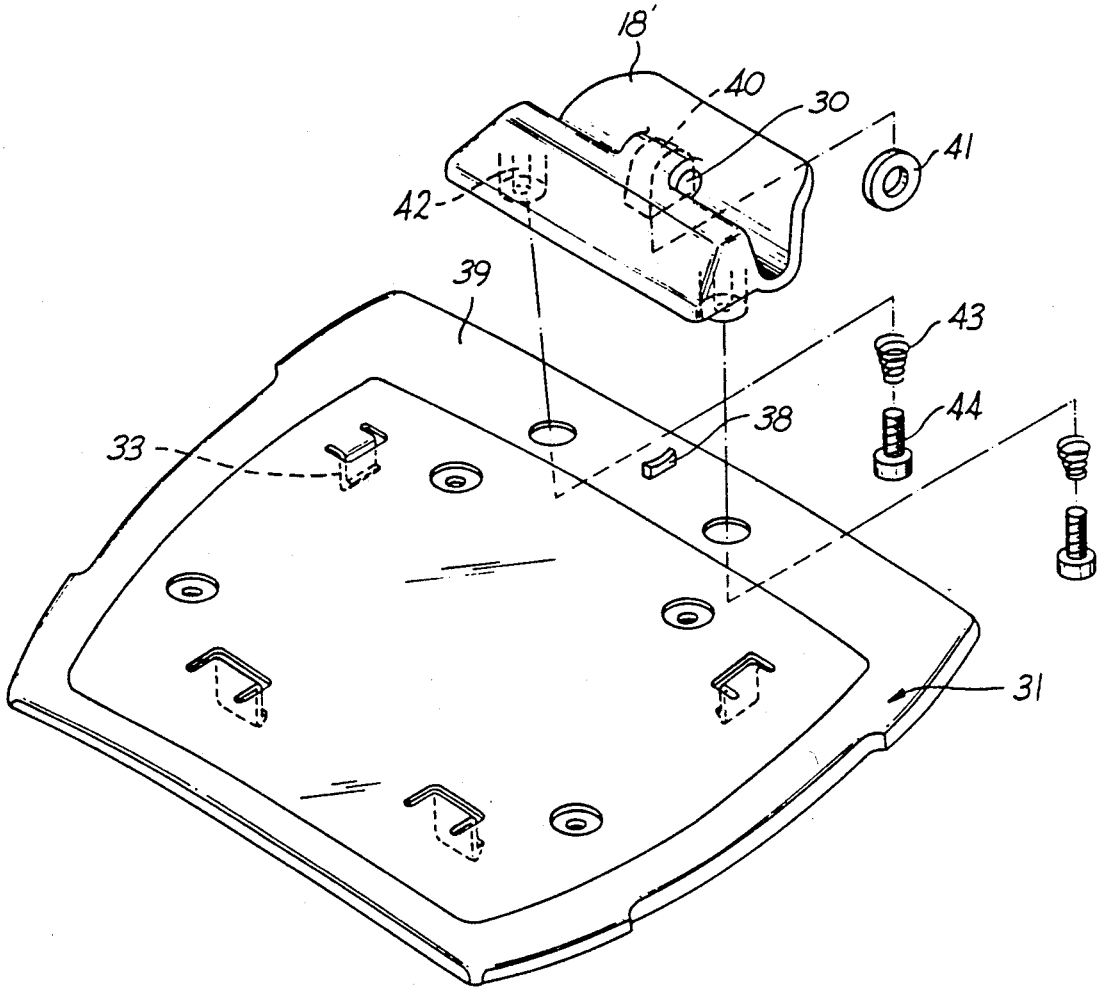
FIG. 4 is an exploded perspective view illustrating the assembly of separate pencil holder housing and scorecard panels into a scorekeeping accessory unit.

The pencil storage housing structure 18' is affixed to the score card receiving planar panel 31 in the manner shown in FIG. 4. In this view, the internal receptacle 40, shown in dotted line outline, receives the o-ring 41 as indicated by the phantom lines. The housing structure pencil receiving aperture 30 is thus coaxially algined with the aperture of the o-ring 41 when the o-ring rests upon the nest 38 on the upper border surface 39 of the score card accessory 31. The pencil storage housing is affixed to the score card panel 31 by means of receptacle holes 42 in the pencil housing body made of plastic of metal, into which the springs 43 and screws fit, as indicated by the phantom lines.

Figure 5:
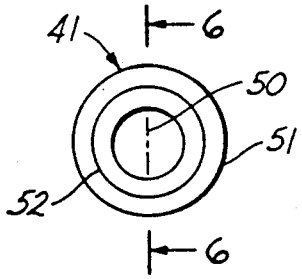
FIG. 5 is side view of an o-ring pencil body holder provided in accordance with the invention.
Figure 6:
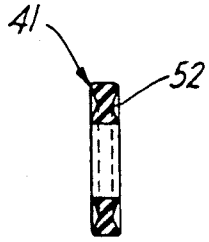
FIG. 6 is a section view taken along lines 6-6 of FIG. 5 of the o-ring.
Figure 7:
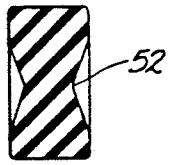
FIG. 7 is an enlarged section view of a preferred o-ring body configuration for resiliently and frictionally grasping a pencil body of various dimensions and shapes.

The o-ring structure could be replaced by equivalent resilient pads of other shape, but the term "o-ring" as used herein in intended to identify in general one or more resilient rubber or plastic members shaped for engaging and retaining the body of a pencil. The preferred embodiments of this o-ring structure are shown in FIGS. 5 to 7. The resilient rubber or plastic material is preferably a **60*d* duro hardness silicone rubber. The diameter of the inner aperture is 0.255 inch (0.65 cm). The outer diameter is one half in (1.3 cm). To increase the pencil grasping radial resiliency function of the o-ring permitting it to accomodate larger sized pencil bodies without wear or damage to the o-ring, the identation groove 52 is provided on each side of the o-ring. The thickness of the o-ring is 0.153 inch (0.39 cm) and the thickness at the identation 52** roughly half that.

It is therefore seen that this invention provides an improved pencil storage housing with particular utility with a golf scorekeeping accessory that may be mounted on the steering wheel assembly of a golf cart. Those features of novelty describing the spirit and nature of the invention are set forth with particularity in the following claims.

I claim:

1. A golf scorekeeping accessory for storing and protecting a pencil with a writing point that is easily broken at a writing surface site adapted to position a scorecard for making entries thereon, comprising in combination, a pencil storage housing structure defining a guide groove dimensioned to receive a pencil and guide it into a storage position, and means for retaining a resilient o-ring in a position to receive a pencil body guided thereinto from said groove having an inner diameter and resiliency such that it will firmly frictionally and resiliently grip pencil bodies of a range of different diameters in a position preventing contact of the point with the housing structure.

2. An accessory as defined in claim 1 further comprising a score card receiving planar panel, and means affixing the panel and the pencil storage housing together in a configuration adapted to permit a user to remove a pencil from the o-ring, make an entry on a scorecard situated on said panel and return the pencil to the o-ring storage position.

3. An accessory as defined in claim 2 affixed to the steering wheel of a golf cart.

4. The accessory as defined in claim 3 further comprising a steering wheel assembly on the golf cart positioning a plurality of snap in, friction fit receptacles about a steering shaft, and frictionally operable detent clips affixed to said panel for mating into the receptacles to mount the accessory in place on the steering wheel assembly.

5. The accessory as defined in claim 1, further comprising a pencil point protection hood on said housing structrue positioned to protect a point of a pencil held in said o-ring from breaking from impact of external forces.

6. The accessory as defined in claim 1 with an o-ring of silicone rubber having a hardness in the range of **60*d*** duro.

7. The accessory as defined in claim 1 with an o-ring indented on two opposite surfaces for increasing radial resiliency in response to pencil bodies inserted axially into the o-ring.

8. The accessory as defined in claim 1 further comprising a guide groove extending on opposite sides of said o-ring to permit entry of a pencil from opposite sides respectively by left-handed and right handed users.

9. A storage holder for a pencil with a writing point adapted to be positioned at a writing surface for ready access for use, comprising in combination, housing structure forming a generally laterally disposed guide groove in the holder for receiving a pencil pointed end and directing the pencil into a storage position protecting the writing point from external forces and objects tending to contact break the point, housing structure adjacent to and extending from the groove for receiving the pencil in a stored position when manually inserted and for holding the pencil in position for manual removal upon demand, and resilient pencil body retention means held in the housing structure to receive pencil bodies of various dimensions comprising a resilient o-ring mounted in the housing structure to receive the pointed end of the pencil from the guide groove when manually inserted to frictionally hold the pencil body in an accessible position for manual removal of the pencil from the holder upon demand.

10. The storage holder defined in claim 9 further comprising an o-ring of inner diameter about 0.25 inch (0.6 cm) and outer diameter about 0.5 inch (0.13 cm) and thickness about 0.15 inch (0.4 cm) with sidewall circular grooves on two opposite sides about 0.035 inch (0.09 cm) deep.

11. The storage holder defined in claim 9 further comprising, a protective hood receptacle member in said housing disposed over said groove to form a substantially cylindrical housing about the pencil body thereby to protect a pointed end of the pencil from impact by external objects when a pencil is stored in the holder.

12. The storage holder defined in claim 9 further comprising symmetrical said guide grooves on opposite sides of the o-ring to accomodate entry from either of the opposite sides respectively by left handed or right handed pencil users.

13. A pencil holder comprising in combination, an o-ring of resilient material, a housing having a groove open at two ends to receive a pencil, a compartment confining said o-ring at an intermediate position along the groove to define a receiving aperture alinged to receive in mating registration a pencil body axially into the o-ring to resiliently and frictionally hold the pencil in place for manuel retrieval and use, and pencil point protection means covering the groove on opposite sides of the o-ring.

* * * * *